US006293541B1

(12) United States Patent
Horiuchi et al.

(10) Patent No.: US 6,293,541 B1
(45) Date of Patent: Sep. 25, 2001

(54) SHEET FEED UNIT HAVING GUIDE WITH SHEET GUIDE SURFACE PLACED AT CONFLUENCE OF TWO TRANSPORT PATHS

(75) Inventors: Takao Horiuchi; Toshihiro Horiuchi, both of Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/075,061

(22) Filed: May 8, 1998

(30) Foreign Application Priority Data

May 21, 1997 (JP) ..... 9-131022

(51) Int. Cl.[7] ..... B65H 29/00

(52) U.S. Cl. ..... 271/184; 271/9.02; 271/9.09; 271/9.1; 271/225; 271/272; 271/9.03; 271/309; 271/311; 271/9.13

(58) Field of Search ..... 271/9.02, 9.09, 271/9.1, 9.13, 225, 272, 9.03, 184; 355/309, 311

(56) References Cited

U.S. PATENT DOCUMENTS

| | | | | |
|---|---|---|---|---|
| 5,155,537 | * | 10/1992 | Komatsu et al. | 355/309 |
| 5,221,951 | * | 6/1993 | Sakamoto | 355/311 |
| 5,303,017 | | 4/1994 | Smith . | |
| 5,310,174 | * | 5/1994 | Thomas | 271/225 |
| 5,448,348 | * | 9/1995 | Azeta | 271/291 X |
| 5,449,164 | * | 9/1995 | Quesnel et al. | 271/186 X |
| 5,581,289 | * | 12/1996 | Firl et al. | 271/3 X |
| 5,651,539 | * | 7/1997 | Yoshiuchi et al. | 271/9.1 X |
| 5,732,321 | * | 3/1998 | Ishizuka et al. | 271/9.11 X |

FOREIGN PATENT DOCUMENTS

| | | | | |
|---|---|---|---|---|
| 574 043 | | 12/1993 | (EP) . | |
| 579 168 | | 1/1994 | (EP) . | |
| 4-173637 | | 6/1992 | (JP) . | |
| 5-032341 | | 2/1993 | (JP) . | |
| 5-294518 | * | 11/1993 | (JP) | 271/9.13 |
| 5-294518 | * | 1/1994 | (JP) | 271/9.13 |
| 6-1488 | * | 1/1994 | (JP) | 271/9.13 |
| 6-092507 | | 4/1994 | (JP) . | |

* cited by examiner

*Primary Examiner*—Robert P. Olszewski
*Assistant Examiner*—Richard Ridley
(74) *Attorney, Agent, or Firm*—David G. Conlin; William J. Daley, Jr.; Dike, Bronstein, Roberts & Cushman, Intellectual Property Practice Group

(57) ABSTRACT

Featured is a sheet feed unit including a first transport path in which is transported a first sheet, a second transport path and a protrusion. A second sheet is transported in the second transport path and guided at a prescribed angle relative to the first transport path. The protrusion is located or fixed at a confluence of the first transport path and the second transport path. The protrusion also has a guide surface that is placed to allow the second sheet to be guided along the first transport path.

19 Claims, 6 Drawing Sheets

SHEET FEED UNIT HAVING GUIDE WITH SHEET GUIDE SURFACE PLACED AT CONFLUENCE OF TWO TRANSPORT PATHS

BACKGROUND OF THE INVENTION

1. Field of the Invention

The present invention relates to a sheet feed unit used in an image forming apparatus or the like, and particularly to a sheet feed unit which stably transports and guides a sheet to be fed while decreasing the noise produced when a trailing edge of a sheet to be fed springs up.

2. Description of the Background Art

By an image forming apparatus, for example, an image forming apparatus using the electrophotographic system, a toner image is formed on a photoreceptor which is a recording medium, and the toner image is transferred onto a sheet such as a plain paper. In order to hold the toner image on the sheet as a permanent image, the sheet is passed through, for example, a heating and fixing unit for fixing the toner, and the sheet is thereafter discharged from the body of the apparatus.

In such an image forming apparatus, a sheet should be transported to an image forming location in order to form a desired image on the sheet. A number of sheets are contained in a paper feed cassette, for example, and a sheet feed unit is provided for transporting the sheets one by one from the cassette to an image forming unit, especially to a transport path which leads to a transfer location where the toner image formed on the photoreceptor is transferred.

According to the invention recited in Japanese Patent Laying-Open No. 5-32341, a body of an image forming unit including a photoreceptor is placed on a paper feed cassette containing a number of sheets as described above in order to entirely reduce an image forming apparatus in size, particularly to decrease an installation area of the apparatus. A plurality of paper feed cassettes housing sheets of different sizes are successively placed on one another under the body of the image forming unit for accommodating various sheet sizes, while the installation area of the image forming apparatus is not changed at all compared with that of a conventional image forming apparatus.

Since the image forming apparatus has such a structure as described above, the transport path where a sheet is fed from the paper feed cassette to the image forming unit as described above is structured such that the path includes a curved reverse section. Therefore, when the trailing edge of the sheet to be fed passes through the reverse section, the edge springs up and noise is produced. On the other hand, when the leading edges of sheets fed from paper feed cassettes of an upper stage and of a lower stage are guided toward the curved reverse section, they are transported at different angles, that is, those sheets touch the guide at different angles. As a result, poor feeding, jam and the like due to different feeding conditions, as well as sound caused by the leading edge hitting against the guide could be produced.

According to Japanese Patent Laying-Open No. 6-92507, a guide mechanism for the sheet feed unit as shown in FIGS. 1A and 1B is provided. Specifically, a curved reverse guide section which can be rotated is provided such that the leading edge of a sheet fed from a paper feed cassette of an upper or a lower stage approaches the curved reverse guide section at a constant angle, particularly 45° or less, in order to prevent the poor feeding of a sheet or the like.

Referring to FIG. 1A, a sheet fed from a paper feed cassette of an upper stage 50 is guided through a pair of transport rollers 51 to a reverse guide section 52, and sent toward a resist roller 53 placed at a portion preceding an image forming unit. Referring to FIG. 1B, a sheet fed from a paper feed cassette of a lower stage (not shown) placed under the upper stage paper feed cassette 50 is guided through transport rollers (not shown) having the same structure as that of transport rollers 51, along a vertical guide 54, to reverse guide section 52 in a direction of the arrow Y.

A sheet transported from the paper feed cassette of the upper or the lower stage is guided to reverse guide section 52 in X or Y direction. The sheets transported from the upper feed cassette and the lower feed cassette approach and touch reverse guide section 52 at different angles. As shown in FIGS. 1A and 1B, a part 52*a* of reverse guide section 52 is rotatably supported by an axis and urged by a spring 55 in the clockwise direction. An actuator 57 is attracted to a solenoid 56 placed oppositely to spring 55, and part 52*a* of reverse guide section 52 is rotated in the counterclockwise direction against the urging force of spring 55.

When a sheet is transported from upper stage paper feed cassette 50, solenoid 56 is electrified so that part 52*a* of reverse guide section 52 is set in the state shown in FIG. 1A. When a sheet is transported from the lower stage paper feed cassette, solenoid 56 is not electrified, and part 52*a* of reverse guide section 52 is set in the state shown in FIG. 1B by the urging force of spring 55.

Accordingly, a sheet Px fed from upper stage paper feed cassette 50 is transported to part 52*a* of reverse guide section 52 positioned as shown in FIG. 1A in the X direction. A sheet Py fed from the lower stage paper feed cassette is transported to part 52*a* of reverse guide section 52 as shown in FIG. 1B in the Y direction. Consequently, those sheets are guided to part 52*a* of reverse guide section 52 at an approximately same angle (45° or less), so that the sheet can be stably fed.

The angle at which a sheet fed from the upper or the lower paper feed cassette is transported to reverse guide section 52 constituting a reverse path is thus adjusted. At least an angle at which the leading edge of the sheet touches reverse guide section 52, in other words, an angle, formed by the direction in which a sheet approaches and a guide surface, when the leading edge of the sheet touches reverse guide section 52, is 45° or less. As a result, a sheet is stably transported and guided. In addition, the noise produced when the trailing edge of a sheet springs up upon passing the reverse section can be reduced.

Using the sheet feed unit having the structure shown in FIGS. 1A and 1B provided for a conventional image forming apparatus, the noise produced when the trailing edge of a sheet springs up can be decreased, while the sheet can be stably transported.

However, part 52*a* of reverse guide section 52 should be rotatably placed as shown in FIGS. 1A and 1B. Therefore, a space for rotating part 52*a* is required, and the structure of the apparatus becomes complicate. Further, the apparatus is large since solenoid 56 and the like are provided, resulting in increase in cost.

In addition, current should be applied to solenoid 56, power consumption increases, and power consumption cannot be decreased.

SUMMARY OF THE INVENTION

An object of the present invention is to provide a sheet feed unit by which any noise produced when the trailing edge of a sheet which is transported springs up is eliminated by a simple structure, the sheet can be stably transported and guided, and an image forming apparatus can be entirely reduced in size.

According to one aspect of the invention, a sheet feed unit includes a first transport path along which a first sheet is transported, a second transport path along which a second sheet is transported and guided at a prescribed angle relative to the first transport path, and a protrusion placed at a confluence of the first and second transport paths and having a guide surface placed to allow the second sheet to be transported along the first transport path.

The protrusion is placed at the confluence of the first transport path and the second transport path, and has the guide surface placed to allow the second sheet to be transported along the first transport path. Consequently, the first sheet and the second sheet are guided at the same angle, and those sheets can be stably transported and guided. Further, the protrusion is only provided at the confluence of the first and second transport paths, so that a sheet feed unit can be decreased in size.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

A sheet feed unit according to embodiments of the present invention is hereinafter described in detail following the attached figures.

Figure 1A:
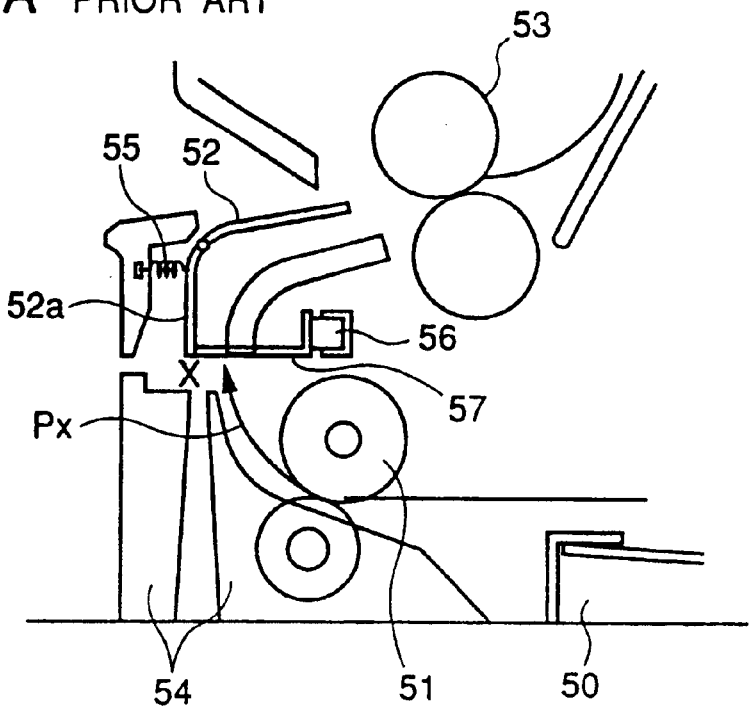
FIG.1A PRIOR ART
FIG. 1A is a cross sectional view of a conventional sheet feed unit in which a paper is transported from a feed cassette of the upper stage.
Figure 1B:
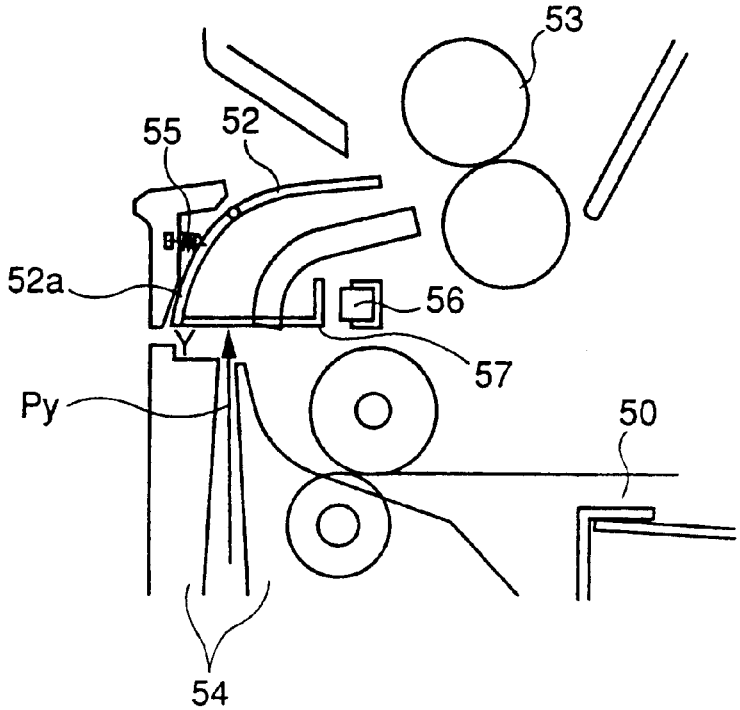
FIG.1B PRIOR ART
FIG. 1B is a cross sectional view of the conventional sheet feed unit in which a paper is transported from a feed cassette of the lower stage.
Figure 2:
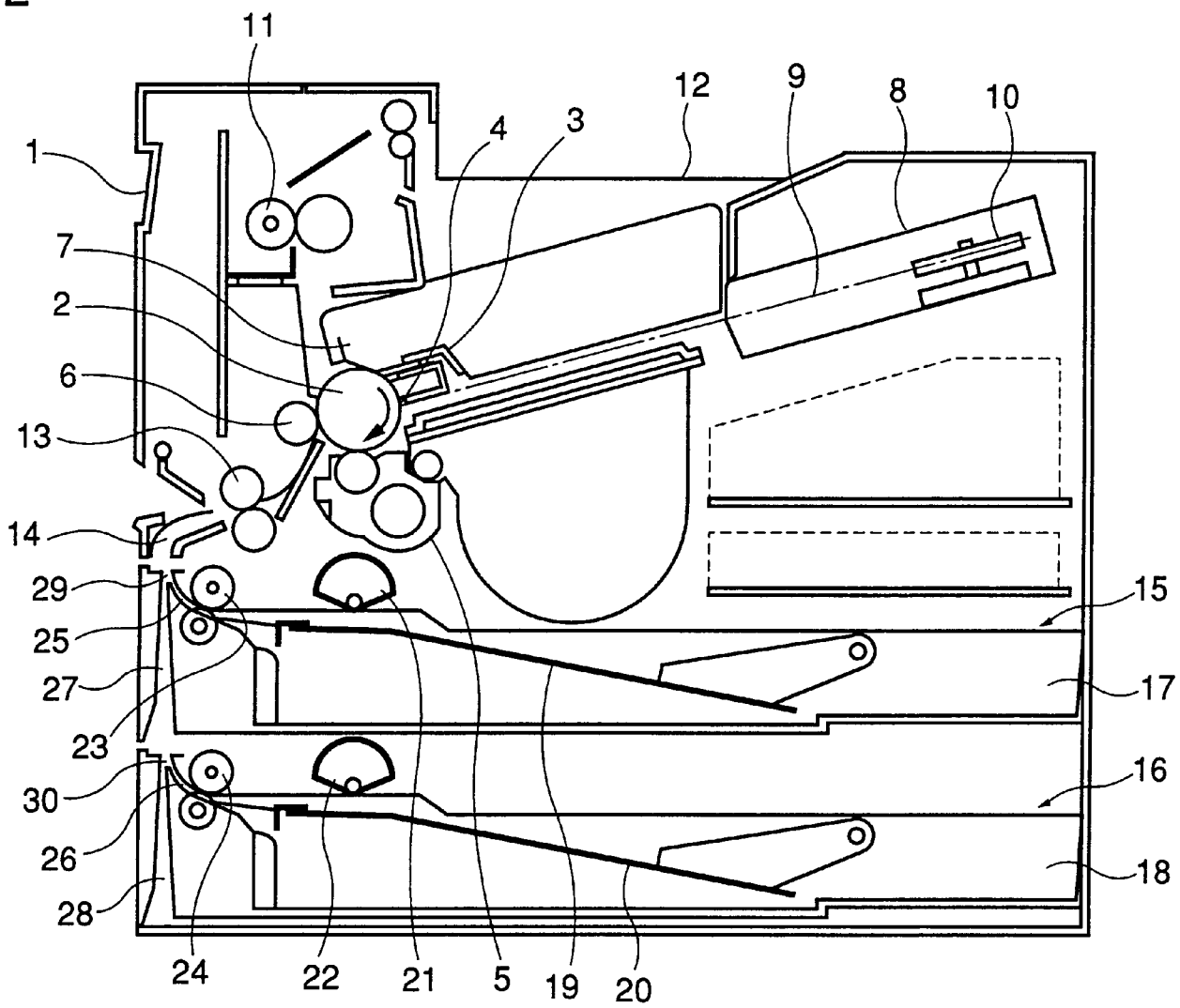
FIG. 2 is a cross sectional view of an entire structure of a laser printer as one example of an image forming apparatus provided with a sheet feed unit of the present invention.

FIG. 2 shows an image forming apparatus 1 which is a laser printer. However, the present invention is not limited to a feed unit in the laser printer, and is applicable to all of the feed units that generally supply a sheet to a position as required. Examples of the image forming apparatus are the normal copying apparatus, the ink jet printer forming an image by the ink jet method, the thermal printer forming an image by thermal transfer, and the like, as well as the facsimile apparatus having either of such printers. A sheet feed unit according to the present invention hereinafter described is applicable to a sheet feed unit which feeds a sheet to a position where necessary in those image forming apparatuses.

Referring to FIG. 2, a body of image forming apparatus 1 includes a photoreceptor 2 which is a recording medium rotating in the direction of the arrow shown in the figure and having a photo-conductive layer formed on its surface, a charger 3 arranged oppositely to photoreceptor 2 and charging the surface of photoreceptor 2 uniformly in the direction of the rotation of photoreceptor 2, an exposure unit 4 which exposes an image on the surface of photoreceptor 2 after it is charged, a developer 5 which develops an electrostatic latent image formed by the exposure, a transfer unit (transfer roller) 6 which transfers a toner image after the development onto a sheet, and a cleaning unit 7 which removes any residual toner after the transfer.

Exposure unit 4 provided for exposing an image on the surface of photoreceptor 2 directs a laser beam 9 emitted from a laser radiation unit 8 onto the surface of photoreceptor 2. Laser radiation unit 8 drives a semiconductor laser (not shown) to be turned on or off according to image data supplied, and allows laser beam 9 to scan in the direction of a rotation axis of photoreceptor 2 by a polygon mirror 10 which is a polariscope. Consequently, laser beam 9 is directed onto the surface of photoreceptor 2 which is uniformly charged by charger 3, and an electrostatic latent image according to the image is formed.

The electrostatic latent image formed on photoreceptor 2 is developed by developer 5 to become a toner image. The toner image thus formed is transferred by the operation of transfer roller 6 onto a sheet fed via a sheet feed unit according to the present invention.

A sheet feeding system is next described. The feeding system allows a sheet to be sent to a transfer location opposite to transfer unit 6 as described above. After a transfer process, the feeding system further allows the sheet separated from photoreceptor 2 to be transported to a copy receiving tray 12 placed at an upper portion of the body of image forming apparatus 1 via a heating and fixing unit 11, and the sheet is discharged therefrom one by one. A resist roller 13 placed for transferring the sheet to the transfer location synchronously with rotation of photoreceptor 2 is arranged preceding the transfer location (on the upstream side), and a carry path 14 provided for feeding the sheet to resist roller 13 is placed on the upstream side of resist roller 13.

Carry path 14 communicates with a path where a sheet is guided from an upper stage paper feeding section 15 and from a lower stage paper feeding section 16 that are placed at the lower portion of the body of image forming apparatus 1.

Upper stage and lower stage paper feed sections 15 and 16 having the same structure are respectively provided with paper feed cassettes 17 and 18 that can be drawn out, and are structured such that sheets of a predetermined size can be housed therein. Placement plates 19 and 20 are provided on which sheets housed in the paper feed cassettes are placed. Placement plates 19 and 20 are rotatably supported on the opposite side of the locations thereof which oppose paper feed rollers 21 and 22 respectively, and are always urged to rotate upward by urging means formed of a spring or the like (not shown). Separation claws for limiting lifting of sheets on placement plates 19 and 20 are provided at the two corners of the leading end of each of placement plates 19 and 20 on paper feeding side. Consequently, the top of a sheet is always kept at a constant height.

When no sheet is fed, the chord portions of paper feed rollers 21 and 22 are respectively opposite to placement plates 19 and 20, so that paper feed cassettes 17 and 18 can be drawn out. When a sheet is fed, the arc portion of paper feed roller 21 or paper feed roller 22 touches an uppermost sheet on placement plate 19 or plate 20, and placement plate 19 or 20 is pushed down. The uppermost sheet is gradually transported one by one by the arc portion of paper feed roller 21 or roller 22, and the leading two corners of the uppermost sheet move over the separation claws, and a single sheet is fed.

Transport rollers 23 and 24 are respectively provided correspondingly to transport positions from paper feed cassettes 17 and 18, in order to send a sheet supplied from paper feed roller 21 or roller 22 to carry path 14 described above. Feed paths 25 and 26 where sheets from transport rollers 23 and 24 are sent communicate with carry path 14. Paper feed sections 15 and 16 are provided with vertical paths 27 and 28 that are almost linear in the vertical direction and are placed on the left side of transport rollers 23 and 24. Confluences 29 and 30 are provided where vertical paths 27 and 28 and feed paths 25 and 26 through which sheets are supplied from transport rollers 23 and 24 converge. Confluences 29 and 30 communicate with carry path 14 that leads to an image formation location of image forming apparatus 1.

Paper feed sections 15 and 16 are each formed as a unit, and the number of types of sheets which can be fed can be increased by piling up paper feed sections 15, 16 and the like on one another. Vertical paths 27 and 28 communicate with each other, so that a sheet supplied from the lower stage paper feed section 16 can be transferred to carry path 14. If another paper feed section having the same structure as that of sections 15 and 16 is provided under lower stage paper feed section 16, a sheet from the another paper feed section can be transferred to carry path 14. In this case, a transport roller (not shown) may be provided to each of vertical paths 27 and 28 as transport means for passing a sheet from a lower stage paper feed section through each of vertical paths 27 and 28.

Each of paper feed sections 15 and 16 is provided with a motor and a coupling mechanism (not shown) for driving each of paper feed rollers 21 and 22 as well as each of transport rollers 23 and 24, and is coupled with the body of image forming apparatus 1 by power and signal lines.

(First Embodiment)

Figure 3:
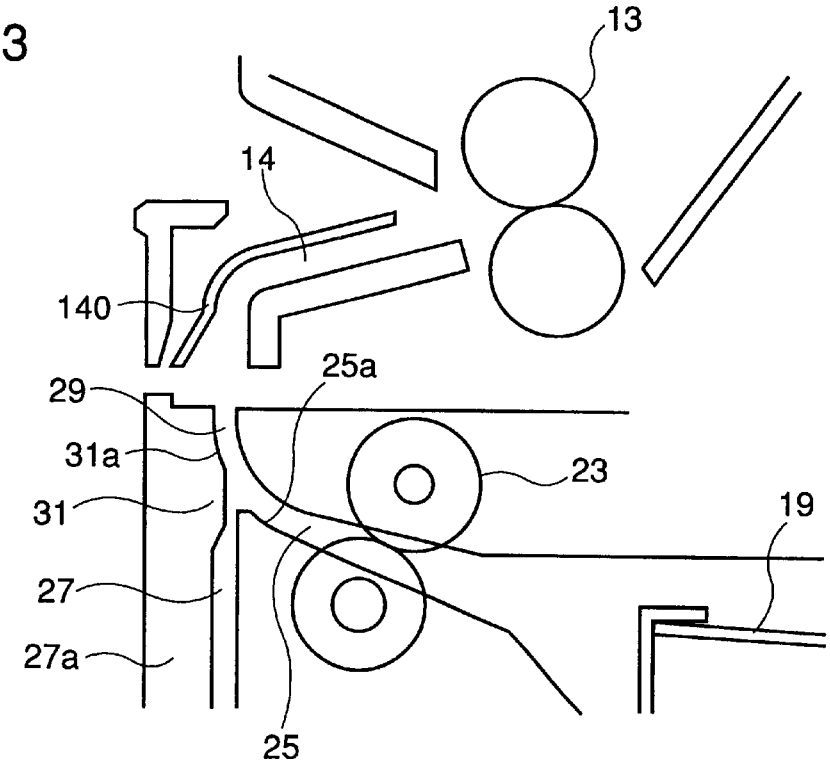
FIG. 3 is a side view of a sheet feed unit according to the first embodiment of the present invention.
Figure 4:
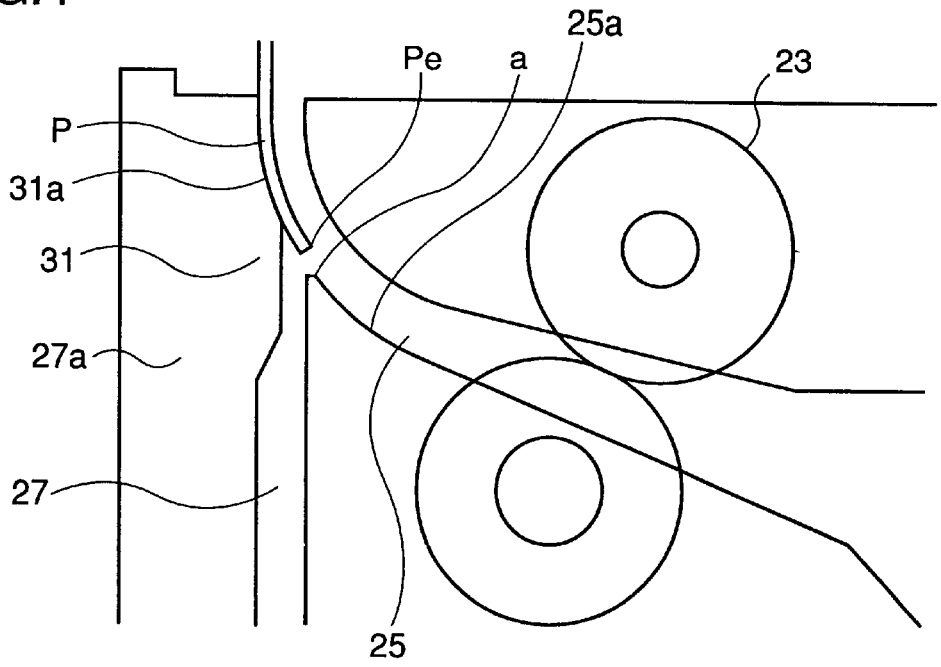
FIG. 4 is an expanded view provided for describing details of a structure of a guide member of the sheet feed unit of FIG. 3.

A sheet feed unit of the image forming apparatus having the structure above according to the present invention, for reducing any noise produced when a sheet springs up and for feeding a sheet stably, is described following FIGS. 3 and 4.

When upper stage paper feed section 15 having the structure described above is selected, a sheet is transported by paper feed roller 21 and transport roller 23, the sheet is passed via confluence 29 of feed path 25 and vertical path 27 to carry path 14. The sheet is guided to resist roller 13 via carry path 14.

When lower stage paper feed section 16 is selected, a sheet is similarly transported by paper feed roller 22 and transport roller 24, passed via confluence 30 of feed path 26 and vertical path 28, and transferred to carry path 14 via the upper vertical path 27. The sheet is then guided to resist roller 13 via carry path 14.

Referring to FIG. 3, confluence 29 where feed path 25 of upper stage paper feed section 15 and vertical path 27 converge communicates with carry path 14. A curved reverse guide section 140 that the leading edge of a supplied sheet touches and that guides the sheet is provided for carry path 14. Accordingly, the leading edge of a sheet supplied via confluence 29 is in contact with reverse guide section 140, and is guided in carry path 14 along the shape of reverse guide section 140 to resist roller 13.

A bottom guide 25*a* which constitutes feed path 25 guiding a sheet fed by transport roller 23 to confluence 29 is shaped such that a surface which guides the sheet is curved upward to communicate with confluence 29. Specifically, a sheet is normally guided toward vertical path 27 at a prescribed angle, and further guided upward along vertical path 27 after hitting against the wall of vertical path 27. In order to smoothly guide the sheet at this time, the guide surface of bottom guide 25*a* of feed path 25 is curved gradually upward along the direction in which the sheet is guided along vertical path 27.

An outer guide 27*a* on the left of vertical path 27 which guides a sheet supplied from lower stage paper feed section 16 to confluence 29 is provided with, a protrusion 31 at confluence 29, particularly a position opposite to an exit of feed path 25 which guides a sheet fed by transport roller 23. Protrusion 31 is placed such that particularly an upper portion 31*a* is located on an extension of the guide surface of bottom guide 25*a* of feed path 25. Since bottom guide 25*a* is curved, upper portion 31*a* of protrusion 31 is also shaped such that it has a curved shape correspondingly to the curve of bottom guide 25*a*.

In the structure described above, when a sheet is first fed from upper stage paper feed section 15, the sheet is sent out by transport roller 23 along feed path 25. At this time, the sheet is guided upward touching bottom guide 25*a*. The leading edge of the sheet is smoothly guided along guide surface 31*a* formed at an upper portion of protrusion 31 provided at confluence 29 located on an extension of bottom guide 25*a*, and guided to confluence 29. The sheet is then guided toward reverse guide section 140 which forms carry path 14 along guide surface 31*a* of protrusion 31 formed to have a curved shape.

The leading edge of a sheet can touch curved reverse guide section 140 at an angle of 45° or less, if the sheet is guided almost vertically by guide surface 31*a* of protrusion 31. Consequently, the leading edge of the sheet can be smoothly guided along reverse guide section 140 to be transported to resist roller 13 in a stable state. In this case, if the shape and the position of reverse guide section 140 are appropriately arranged such that the leading edge of a sheet touches reverse guide section 140 at a still smaller angle, the direction of the travel of the sheet is never forcefully changed when the sheet touches the guide section, and the sheet can be stably transported and guided. Any noise produced when the sheet touches reverse guide section 140 can be reduced or almost eliminated.

The sheet is thereafter sent out synchronously with photoreceptor 2 via resist roller 13, and sent to the image formation location shown in FIG. 2. Referring to FIG. 4, the movement of the trailing edge of the sheet is described below. The sheet is just curved along bottom guide 25*a* of feed path 25 until the trailing edge Pe of sheet P passes a separation point (top) "a" of bottom guide 25*a* of feed path 25, so that any noise produced when the trailing edge of the sheet springs up never occurs. Still referring to FIG. 4, trailing edge Pe of sheet P is supported by no member and becomes free after it passes separation point a of bottom guide 25*a*. Consequently, the repulsion accumulated when the sheet is curved allows the trailing edge of the sheet to extend in a direction opposite to the curve. If protrusion 31 is not provided to outer guide 27*a* of vertical path 27, trailing edge Pe of the sheet springs up to the surface of outer guide 27*a* and collides with the surface with a great force, resulting in a loud sound.

However, protrusion 31 allows sheet P to be guided with its shape curved, so that the force generated when the sheet springs up is reduced after trailing edge Pe passes separation point a, and the sheet can be guided along the shape of bottom guide 25*a* as it is.

By shaping guide surface 31*a* located at the upper portion of protrusion 31 so that the guide surface 31*a* coincides with the extension of the guide surface of bottom guide 25*a*, trailing edge Pe of sheet P never springs up and the sheet trailing edge can be guided while the sheet itself is curved. As a result, any noise produced when trailing edge Pe of sheet P springs up and collides with the guide surface can be eliminated.

When lower stage paper feed section 16 is selected and a sheet P is fed therefrom, the sheet is transported from paper feed cassette 18, guided along vertical path 27 vertically, and sent to confluence 29. The leading edge of the sheet is guided vertically as it is, and touches reverse guide section 140 of carry path 14 via confluence 29. At this time, an angle formed by the leading edge of the sheet from the lower feed section 16 and the reverse guide section is approximately equal to an angle formed by the reverse guide section and the leading edge of the sheet from the upper feed section 15. In addition, the trailing edge of the sheet is vertically guided as it is, so that the trailing edge never springs up and no noise is produced.

Sheets fed from any direction touch reverse guide section 140 at the same angle. Therefore, reverse guide section 140 is not required to freely rotate, an angle formed by the leading edge of a sheet and the reverse guide section can be set at a fixed value or less, and the sheet can be stably fed and guided. By appropriately shaping guide surface 31*a* of protrusion 31 placed at confluence 29, an angle formed by the leading edge of a sheet and reverse guide section 140 can be decreased without adjusting rotation of reverse guide section 140.

Since reverse guide section 140 is not required to rotate, any space necessary for the rotation can be decreased. Since a structure and a drive mechanism for rotating reverse guide section 140 are unnecessary, the entire apparatus can be further decreased in size, resulting in reduction of cost.

Figure 5:
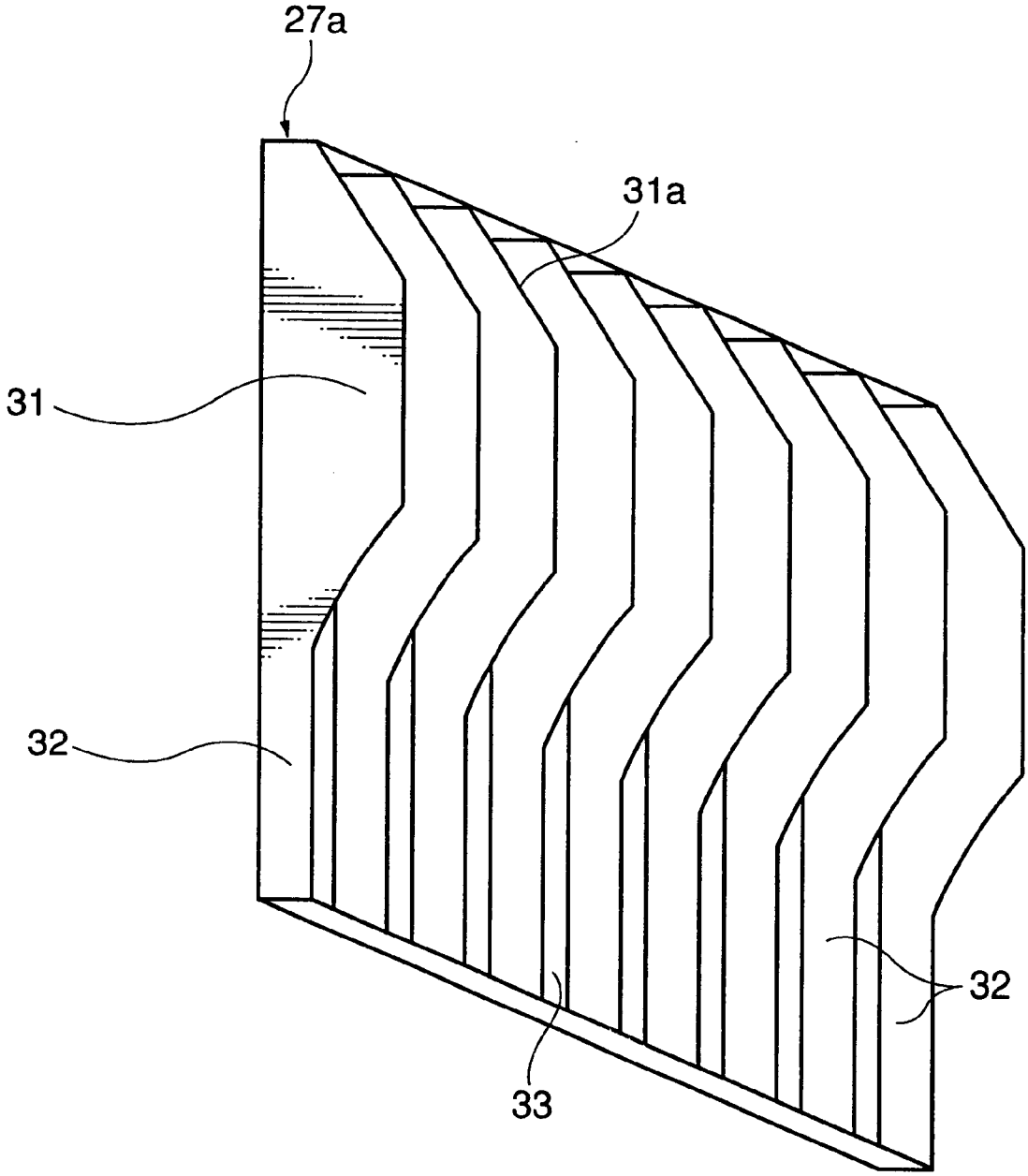
FIG. 5 is a perspective view showing one example of a sheet guide portion constituting the sheet feed unit of the present invention.

Protrusion 31 provided to outer guide 27*a* formed at vertical path 27 is formed, for example, as shown in FIG. 5, by providing a plurality of guide ribs 32 arranged along the direction in which a sheet is transported such that the ribs stand on a sidewall 33 with a prescribed interval therebetween, and by integrally shaping protrusions 31 with guide ribs 32. The shape of guide surface 31*a* can be easily curved while protrusion 31 can be simply formed. Further, guide surface 31*a* can be shaped to be coincident with an extension of a guide path of bottom guide 25*a* of feed path 25. All guide ribs 32 do not need to have protrusions 31 respectively, and protrusion 31 may be located as required. For example, protrusions 31 may be provided to every two or three of guide ribs 32.

When a sheet is supplied from lower stage paper feed section 16, noise is similarly produced due to the trailing edge of the sheet which springs up at confluence 30 of a feed path 26 and a vertical path 28 where a sheet from a lower paper feed unit is guided. Specifically, when the trailing edge of a sheet fed from lower paper feed section 16 is separated from a bottom guide (26*a*), the trailing edge hits against the confluence of vertical path 28, resulting in any noise produced when the sheet springs up. Therefore, protrusion 31 as described above is also provided at confluence 30 of feed path 26 and vertical path 28. In this case, the leading edge of the sheet sent from feed path 26 and vertical path 28 is transferred along vertical path 27 described above. Accordingly, the sheet is surely transferred to resist roller 13 along curved reverse guide 140.

(Second Embodiment)

Figure 6:
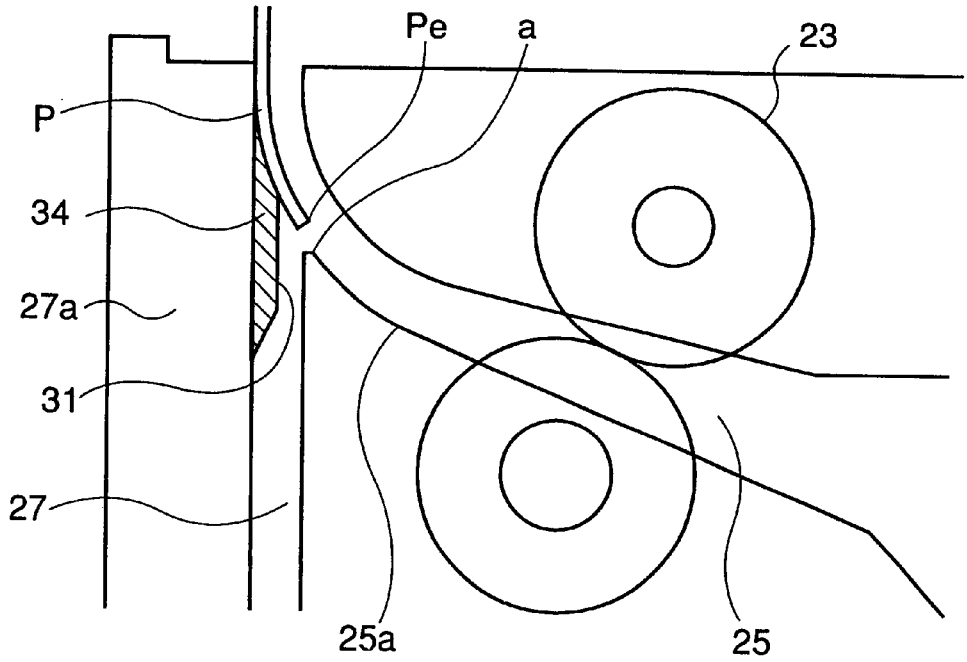
FIG. 6 is a side view provided for describing a structure of a sheet feed unit according to the second embodiment of the present invention.

A sheet feed unit according to the second embodiment of the invention is next described in detail referring to the side view of FIG. 6. This embodiment is devised to further reduce or effectively eliminate the noise produced when the trailing edge of a sheet springs up as occurred in the first embodiment.

Referring to FIG. 6, protrusion 31 provided at confluence 29 of feed path 25 and vertical path 27 is formed of an elastic member 34 of, for example, sponge-like silicone rubber or the like.

Trailing edge Pe of sheet P hits against outer guide 27*a* of vertical path 27 with a great force when trailing edge Pe departs from separation point a of bottom guide 25*a* of feed path 25 and springs up for returning to its original state. The force of hitting of the edge against the outer guide 27*a* can be reduced by protrusion 31 formed as above. In addition, since protrusion 31 is formed of elastic member 34, an action force generated by the spring up of sheet trailing edge Pe is absorbed by elastic deformation of protrusion 31, and any noise can be prevented. In this case, since protrusion 31 is formed of elastic member 34 and is elastically deformed with a great action force, there is no need to shape guide surface 31*a* of protrusion 31 in a curved shape. Sheet P can be guided by deformed guide surface 31*a*, for example, curved by the action force of the sheet, so that the sheet can be more effectively guided. Guide surface 31*a* of protrusion 31 is not required to be formed in a curved shape. Guide surface 31*a* is deformed to curve by resilience of sheet P, and sheet P can be stably guided. A curved guide surface 31*a* of protrusion 31 is unnecessary, so that protrusion 31 can be easily formed.

(Third Embodiment)

Figure 7:
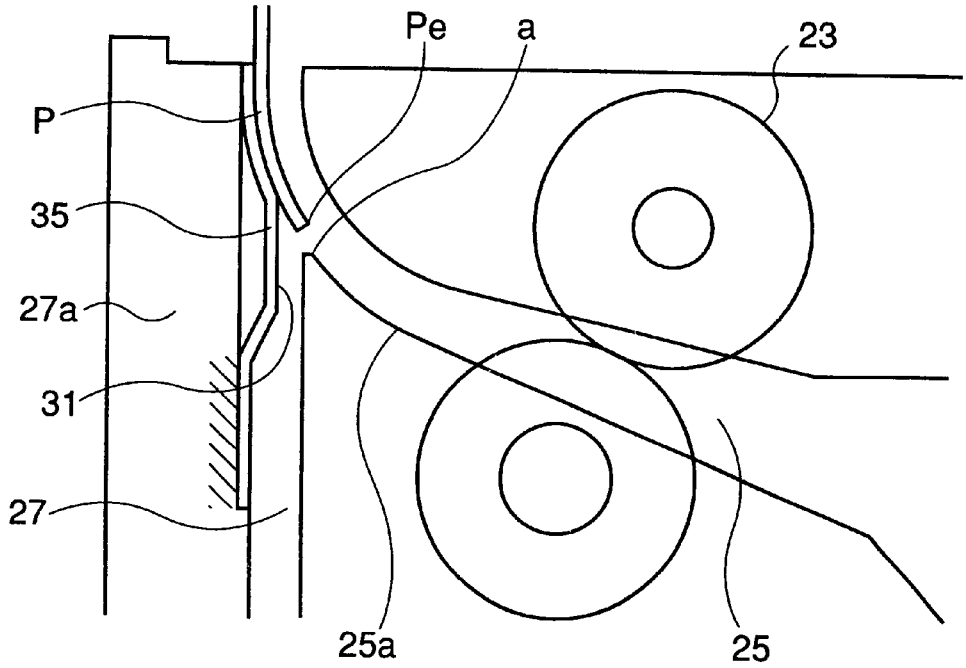
FIG. 7 is a side view provided for describing a structure of a sheet feed unit according to the third embodiment of the present invention.

With reference to FIG. 7, a sheet feed unit according to the third embodiment is provided with protrusion 31 formed of a flexible film 35 such as a polyester film (trade name "Mylar") or the like which can be deformed. One lower end (shown by oblique lines) of flexible film 35 is fixed to a surface of outer guide 27*a*, and the other end which is on the downstream side of the feeding direction is formed to be in contact with the surface of outer guide 27*a* as a free end.

In such a structure, when trailing edge Pe of sheet P departs from bottom guide 25*a*, spring action of trailing edge Pe occurs to flex flexible film 35 constituting protrusion 31. The spring action is absorbed by flexible film 35 which is deformed. As a result, any noise produced when trailing edge Pe of sheet P springs up is prevented. Protrusion 31 formed of flexible film 35 also has an effect similar to protrusion 31 formed of elastic member 34. Further, friction generated by contact of protrusion 31 and sheet P can be reduced and the sheet can be more stably guided.

Since the leading edge of flexible film 35, specifically the edge on the downstream side of the feeding direction freely moves, guiding of sheet P is not hindered so that sheet P can be more smoothly guided. In particular, flexible film 35 is pressed by trailing edge Pe of the sheet and easily deformed correspondingly to the shape of the trailing edge, so that feeding of sheet P is never disturbed and the sheet can be stably supplied and guided.

(Fourth Embodiment)

In the sheet feed unit shown by any of FIGS. 4, 6 and 7, protrusion 31 is provided at outer guide 27*a* of vertical path 27.

Figure 8:
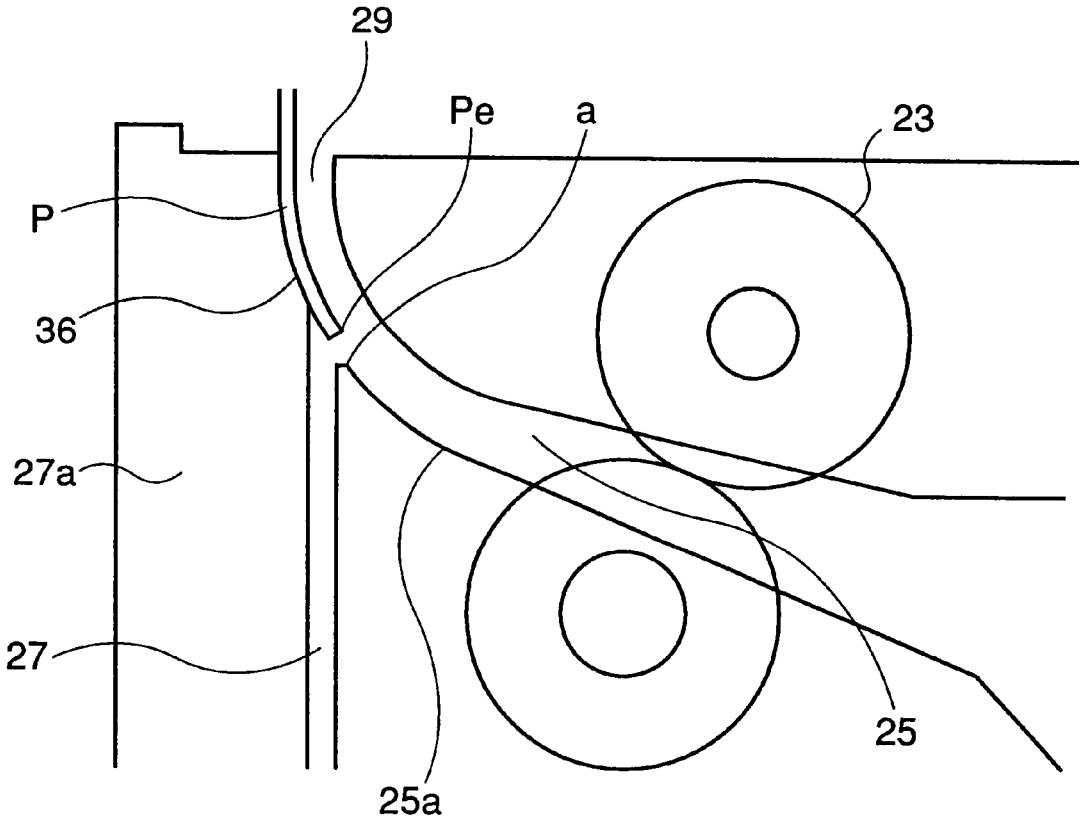
FIG. 8 is a side view provided for describing a structure of a sheet feed unit according to the fourth embodiment of the present invention.

According to the fourth embodiment, no protrusion 31 is provided as shown in FIG. 8. Instead, a confluence guide 36 having a guide surface at a partially formed concave portion of vertical path 27 is located, at confluence 29 of feed path 25 where a sheet supplied from upper stage paper feed section 15 is guided and vertical path 27 where a sheet supplied from lower stage paper feed section 16 is guided. The confluence guide is formed to be coincident with an extended line of feed path 25 in a direction in which a sheet is fed. Confluence guide 36 is provided such that it is located at an extended line of bottom guide 25*a* of feed path 25. Confluence guide 36 is formed according to the curve of bottom guide 25*a*, and formed such that it is ultimately along a direction in which a sheet is guided (vertical direction) along vertical path 27.

The structure also has an effect similar to that of the first embodiment. Specifically, a sheet supplied from upper stage paper feed section 15 and a sheet fed from lower stage paper feed section 16 via vertical path 27 can be guided to reverse guide section 140 in the same state. Therefore, confluence guide 36 can be easily arranged such that an angle formed by the leading edge of the sheet and reverse guide section 140 is set at 45° or less. As a result, any noise produced when the leading edge touches reverse guide section 140 can be prevented and the sheet can be stably guided. There is no need to adjust rotation of reverse guide section 140 and reduction of both of cost and size is possible.

Confluence guide 36 eliminates any noise produced when trailing edge Pe of sheet P springs up. Specifically, a spring action of trailing edge Pe of sheet P supplied from upper stage paper feed section 15, generated when the trailing edge Pe passes bottom guide 25*a* of feed path 25 and tries to return to its original state, is absorbed by confluence guide 36 formed to be along bottom guide 25*a*, so that no noise is produced.

Further, confluence guide 36 can be integrally formed with outer guide 27*a* provided at vertical path 27. Compared with the sheet feed unit having protrusion 31, a sheet can be more stably guided along a transport path of the sheet, particularly vertical path 27 upward, while the structure can be simplified and cost can be reduced.

As heretofore described, a sheet can be fed and guided stably by the sheet feed unit of the present invention. In particular, the leading edge of a sheet supplied selectively from different transport paths can be guided to a next path through a confluence at an almost constant angle. Therefore, there is no need to provide a movable guide or the like, resulting in reduction in size and cost. In addition, any noise produced when the trailing edge of the sheet springs up can be prevented.

If any elastic member, flexible film or the like guides a sheet such that the elastic member or the flexible film absorbs an action of the trailing edge of the sheet which springs up, the effect of preventing noise is further enhanced.

If a guide surface which decreases a force of spring up of the trailing edge is formed at a confluence of different transport paths, a sheet can be more stably fed and guided at the confluence.

According to any embodiment, a movable guide section located where a sheet is guided from a confluence to a next path is unnecessary. Consequently, additional energy for driving the guide section, for example, power consumption can be eliminated, and the entire apparatus can be simplified.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A sheet feed unit comprising:

a first transport path which transports a first sheet from a first source;

a second transport path which transports a second sheet from a second source guided at a prescribed angle relative to said first transport path; and a protrusion fixed at a confluence of said first transport path and said second transport path and being fixed to said first transport path, said protrusion having a curved guide surface placed on an extended line of a guide surface of said second transport path to transport said second sheet along said first transport path in substantially the same direction as said first sheet.

2. The sheet feed unit according to claim 1, wherein said first transport path includes a guide guiding said second sheet at a prescribed angle, and said guide surface is placed on an extended line of said guide in a direction in which said second sheet is guided by said guide.

3. The sheet feed unit according to claim 1, wherein said protrusion is formed of an elastic member.

4. The sheet feed unit according to claim 1, wherein said protrusion is formed of a flexible member.

5. The sheet feed unit according to claim 1, wherein said first transport path further includes a rib guiding said first sheet, and said protrusion is formed integrally with said rib.

6. A sheet feed unit comprising:

a first transport path which transports a first sheet from a first source;

a second transport path which transports a second sheet from a second source guided at a prescribed angle relative to said first transport path; and a first guide, said first guide being formed and fixed in said first transport path and having a concave guide surface placed at a confluence of said first transport and said second transport path, wherein said concave guide surface is placed on an extended line of a guide surface of said second transport path to transport said second sheet along said first transport path in substantially the same direction as said first sheet.

7. The sheet feed unit according to claim 6, wherein said second transport path includes a second guide guiding said second sheet at a prescribed angle, and said concave guide surface is placed on an extended line of said second guide in a direction in which said second sheet is guided by said second guide.

8. A sheet feed unit comprising:

a first transport path which transports a first sheet from a first source;

a second transport path which transports a second sheet from a second source at a prescribed angle relative to said first transport path; and a guide fixed in said first transport path and placed at a location where said second sheet transported through said second transport path meets said first transport path and at a portion facing said second transport path, said guide having a curved guide surface placed on an extended line of a guide surface of said second transport path to transport said second sheet along said first transport path in substantially the same direction as said first sheet.

9. The sheet feed unit according to claim 8, wherein said curved part is formed at the guide which constitutes said first transport path and is an outer guide.

10. The sheet feed unit according to claim 9, wherein said outer guide is formed of a plurality of guide ribs.

11. The sheet feed unit according to claim 8, wherein said curved part is located at an extension of a guide surface which constitutes said second transport path.

12. The sheet feed unit according to claim 8, wherein said first transport path is a vertical transport path which is formed substantially in vertical direction.

13. The sheet feed unit according to claim 8, further comprising a transport roller located on downstream side of a confluence of said first and second transport paths for transporting the sheet.

14. A sheet feed unit comprising:

a first transport path which transports a sheet from a first source of sheets substantially in a vertical direction;

a second transport path which transports a sheet from a second source of sheets at a prescribed angle relative to said first transport path;

a confluence at a location where the sheet transported through said second transport path meets said first transport path; and a concave portion placed at said confluence and fixed in said first transport path, said concave portion having a curved guide surface placed on an extended line of a guide surface of said second transport path to transport the sheet being transported through said second transport path along said first transport path in substantially the same direction as the sheet that would be transported in said first transport path.

15. The sheet feed unit according to claim 14, wherein said concave portion is formed as a partial concave part of a guide constituting said first transport path.

16. The sheet feed unit according to claim 15, wherein said concave portion is formed at an extension of a guide surface by which the sheet transported through said second transport path is guided.

17. A sheet feed unit comprising:

a first transport path which transports a sheet from a first source of sheets substantially in a vertical direction;

a second transport path which transports a sheet from a second source of sheets at a prescribed angle relative to said first transport path;

a guide constituting said first transport path;

a guide surface placed at said guide corresponding to a location where sheets transported through said first and second transport paths meet, said guide surface being shaped into a curve, wherein said curved guide surface is placed on an extended line of a guide surface of said second transport path to transport the sheet being transported through said second transport path along said first transport path in substantially the same direction as the sheet that would be transported in said first transport path; and wherein said guide is formed of a plurality of guide ribs and said guide surface shaped into the curve is integrally formed with said guide ribs.

18. The sheet feed unit according to claim 17, wherein said guide surface corresponds to the confluence where the sheets transported through said first and second transport paths meet, and is formed at an extension of a sheet guide surface of said second transport path.

19. The sheet feeding unit according to claim 1, wherein said first and second sheets are guided upward.

* * * * *